US010245850B2

(12) United States Patent
Espinar Lacueva et al.

(10) Patent No.: US 10,245,850 B2
(45) Date of Patent: Apr. 2, 2019

(54) HEATING GAS BETWEEN AN INLET AND AN OUTLET TO PRINTED MEDIA

(71) Applicant: HEWLETT-PACKARD DEVELOPMENT COMPANY, L.P., Houston, TX (US)

(72) Inventors: Nuria Espinar Lacueva, Igualada (ES); Martin Urrutia Nebreda, Sant Cugat del Valles (ES); Joseba Ormaechea Saracibar, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 21 days.

(21) Appl. No.: 15/314,992

(22) PCT Filed: Jun. 5, 2014

(86) PCT No.: PCT/EP2014/061700
§ 371 (c)(1),
(2) Date: Nov. 30, 2016

(87) PCT Pub. No.: WO2015/185141
PCT Pub. Date: Dec. 10, 2015

(65) Prior Publication Data

US 2018/0065380 A1 Mar. 8, 2018

(51) Int. Cl.

| | |
|---|---|
| ***B41J 11/00*** | (2006.01) |
| ***B41M 7/00*** | (2006.01) |
| ***F26B 21/00*** | (2006.01) |
| ***B41J 3/407*** | (2006.01) |

(52) U.S. Cl.
CPC ..... *B41J 11/002* (2013.01); *B41J 3/4078* (2013.01); *B41M 7/009* (2013.01); *F26B 21/004* (2013.01)

(58) Field of Classification Search
CPC ..... B41J 11/002; B41J 3/4078; B41M 7/009; F26B 21/004; F26B 21/005; F26B 21/006; F26B 21/008; F26B 21/02; F26B 21/022; F26B 21/024; G03G 2215/00666
See application file for complete search history.

(56) References Cited

U.S. PATENT DOCUMENTS

| | | | | |
|---|---|---|---|---|
| 5,504,271 A * | 4/1996 | Curtis | ..... | F26B 3/343 118/61 |
| 6,463,674 B1 * | 10/2002 | Meyers | ..... | B41J 11/002 34/304 |
| 6,813,846 B2 | 11/2004 | Yoshida | | |
| 6,827,435 B2 | 12/2004 | Domoto et al. | | |
| 8,061,833 B2 | 11/2011 | Onozawag et al. | | |

(Continued)

FOREIGN PATENT DOCUMENTS

| | | |
|---|---|---|
| CN | 203449771 | 2/2014 |
| JP | 2001334647 | 12/2001 |

(Continued)

*Primary Examiner* — Henok Legesse
(74) *Attorney, Agent, or Firm* — HP Inc. Patent Department

(57) ABSTRACT

Apparatus to provide heated gas to punted media. The apparatus includes a housing including: an inlet to receive gas from a fan; and an outlet defining at least one slot shaped nozzle to provide heated gas to printed media, the housing defining a direct path between the inlet and the outlet. The apparatus also includes a heater positioned within the housing to heat gas from the inlet.

18 Claims, 5 Drawing Sheets

(56) References Cited

U.S. PATENT DOCUMENTS

| | | | | |
|---|---|---|---|---|
| 8,573,764 | B2 | 11/2013 | Saito et al. | |
| 8,628,188 | B2 | 1/2014 | Toksawa et al. | |
| 9,248,666 | B2 * | 2/2016 | Fuchioka | B41J 11/002 |
| 2005/0253912 | A1 * | 11/2005 | Smith | B41J 2/04553 347/102 |
| 2011/0228289 | A1 | 9/2011 | Yamamoto et al. | |
| 2013/0194367 | A1 * | 8/2013 | Chiwata | B41J 11/0015 347/102 |
| 2014/0028768 | A1 | 1/2014 | Chen | |
| 2014/0043418 | A1 | 2/2014 | Yamamura | |
| 2016/0023476 | A1 * | 1/2016 | Leighton | B41J 11/002 347/102 |

FOREIGN PATENT DOCUMENTS

| | | |
|---|---|---|
| JP | 2004142140 | 5/2004 |
| JP | 2005125158 | 5/2005 |
| JP | 2006/103173 | 4/2006 |
| WO | WO-2014/046665 | 3/2014 |

* cited by examiner

HEATING GAS BETWEEN AN INLET AND AN OUTLET TO PRINTED MEDIA

BACKGROUND

Printer apparatus usually include a print engine to print an image on media (such as a sheet or web of paper). The printer apparatus may also include a dryer to provide air to the printed media to d the printing material forming the printed image.

BRIEF DESCRIPTION

Reference will now be made by way of example only to the accompanying drawings in which.

DETAILED DESCRIPTION

Figure 1:
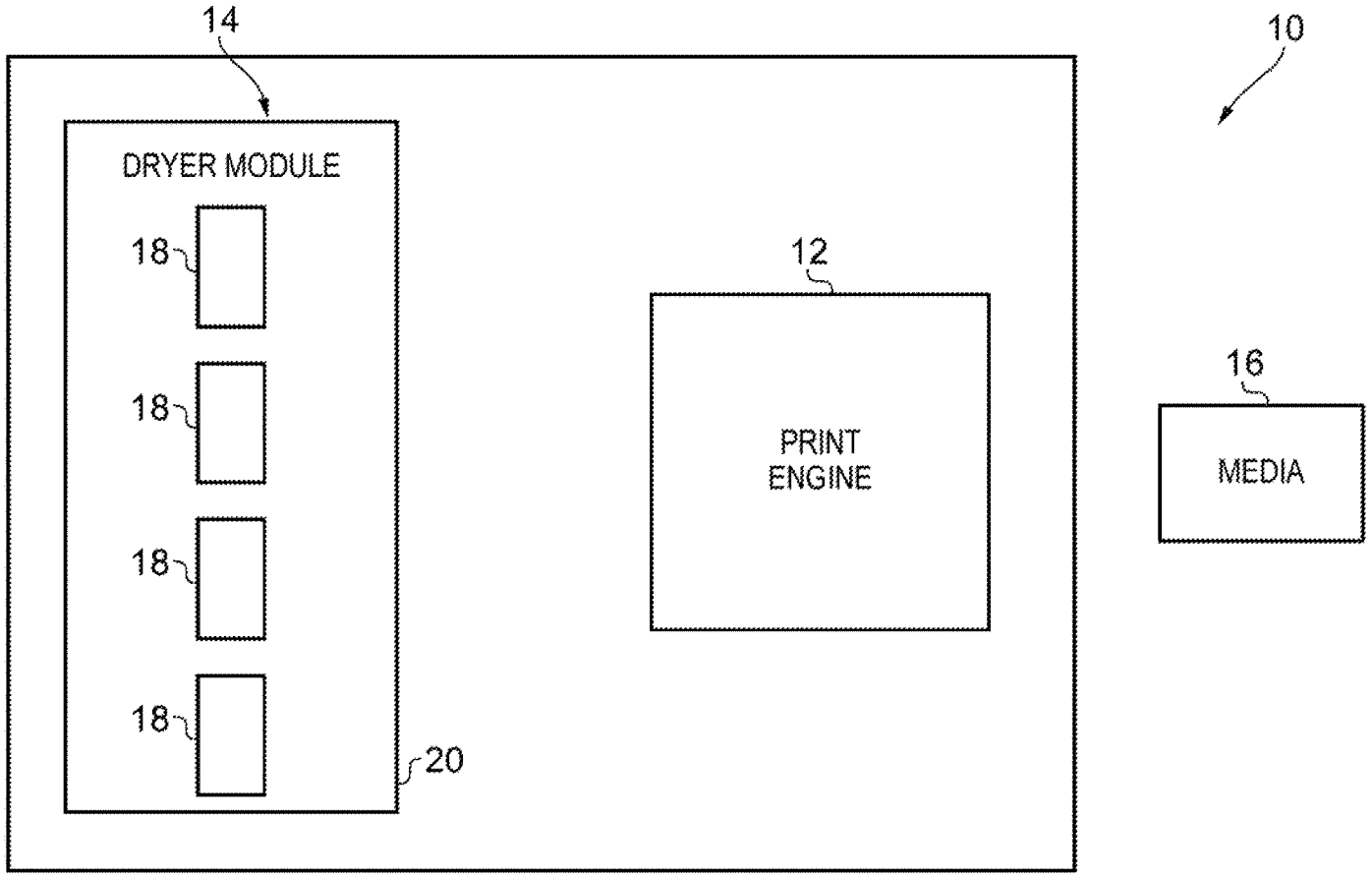
FIG. 1 illustrates a schematic diagram of printer apparatus according to an example.

FIG. 1 illustrates a schematic diagram of a printer apparatus 10 including a print engine 12 and a dryer module 14. The printer apparatus 18 may be any suitable printer and may be, for example, an inkjet printer or a liquid ink electrostatic printer.

The print engine 12 is arranged to print on media 16 using at least one liquid printing material (such as ink for example). The print engine 12 may include a plurality of rollers for moving the media 16 through the printer apparatus 10, and at least one print head, or a roller, for printing at least one liquid printing material on the media 16.

The dryer module 14 is arranged to receive the printed media 16 from the print engine 12 and to dry the liquid printing material printed on the media 16. As used herein, 'module' refers to a unit or apparatus that excludes certain parts or components (such as the print engine 12) that would be added by an end manufacturer or a user. For example, the dryer module 14 may be added to the print engine 12 by an end manufacturer.

In some examples, the print engine 12 is arranged to print on the media 16 using latex ink, and the dryer module 14 is arranged to cure dried latex ink, printed by the print engine 12, on the media 16.

The dryer module 14 includes at least one apparatus 18 to provide heated gas (for example, heated air) to the printed media 16, and may also include a recirculation chamber 20. The at least one apparatus 18 may be replaceable in the dryer module 14 and consequently, the at least one apparatus 18 may also be referred to as a module. For example, the dryer module 14 may be arranged so that a user of the printer apparatus 10 (or a repair technician) may replace an apparatus 18 within the dryer module 14 with another such apparatus. Where the dryer module 14 includes a recirculation chamber 20, the at least one apparatus 18 may be positioned (and replaceable) within the recirculation chamber 20.

The media 16 may be any suitable substrate for receiving at least one liquid printing material. For example, the media 16 may comprise paper, a fabric, a plastic, or a metal. The media 16 may be a sheet or a web of media.

Figure 2:
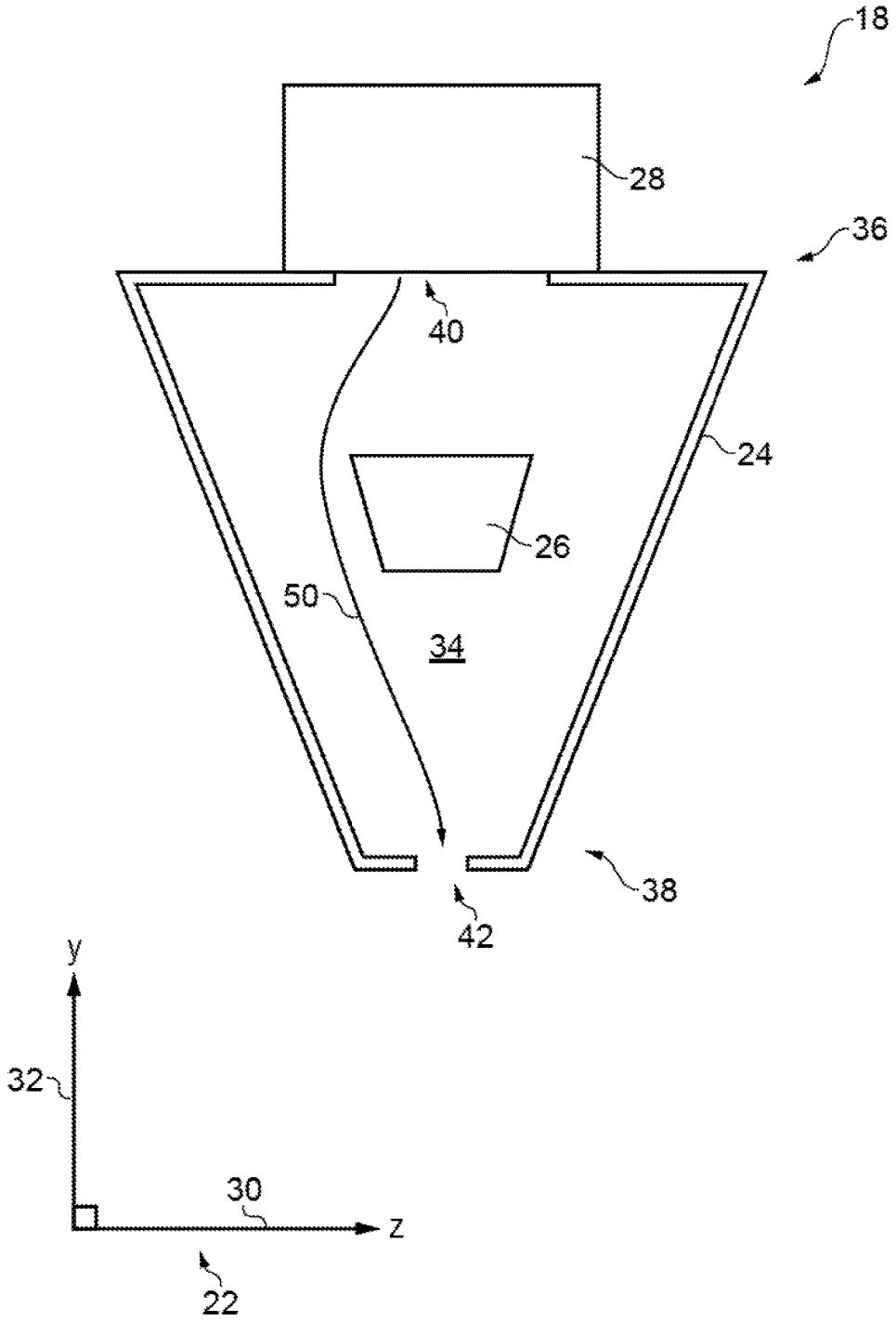
FIG. 2 illustrates a cross-sectional side view diagram of an apparatus according to an example.

FIG. 2 illustrates a cross sectional side view diagram of an apparatus 18 according to an example, and a Cartesian coordinate system 22. The apparatus 18 includes a housing 24, a heater 26 and a fan 28. The Cartesian coordinate system 22 includes a Z axis 30, a Y axis 32 and an X axis 33 (illustrated in FIG. 3) that are orthogonal to one another.

The housing 24 (which may also be referred to as an enclosure) defines a cavity 34 therein. The housing 24 has a first end 36 and an opposite second end 38. At the first end 36, the housing 24 includes an inlet 40 (which may also be referred to as a first opening) to receive a flow of gas (such as air), and an outlet 42 (which may also be referred to as a second opening) to provide a flow of gas.

The cross-sectional shape of the housing 24 changes between the inlet 40 and the outlet 42. As illustrated in FIG. 2, the cross sectional shape of the housing 24 (when viewed from the side) has a trapezium (trapezoid) shape where the first end 36 forms the longer base side, and the second end 38 forms the shorter base side. Consequently, the dimension of the housing 24 in the Z axis 30 decreases from the inlet 40 to the outlet 42.

Figure 3:
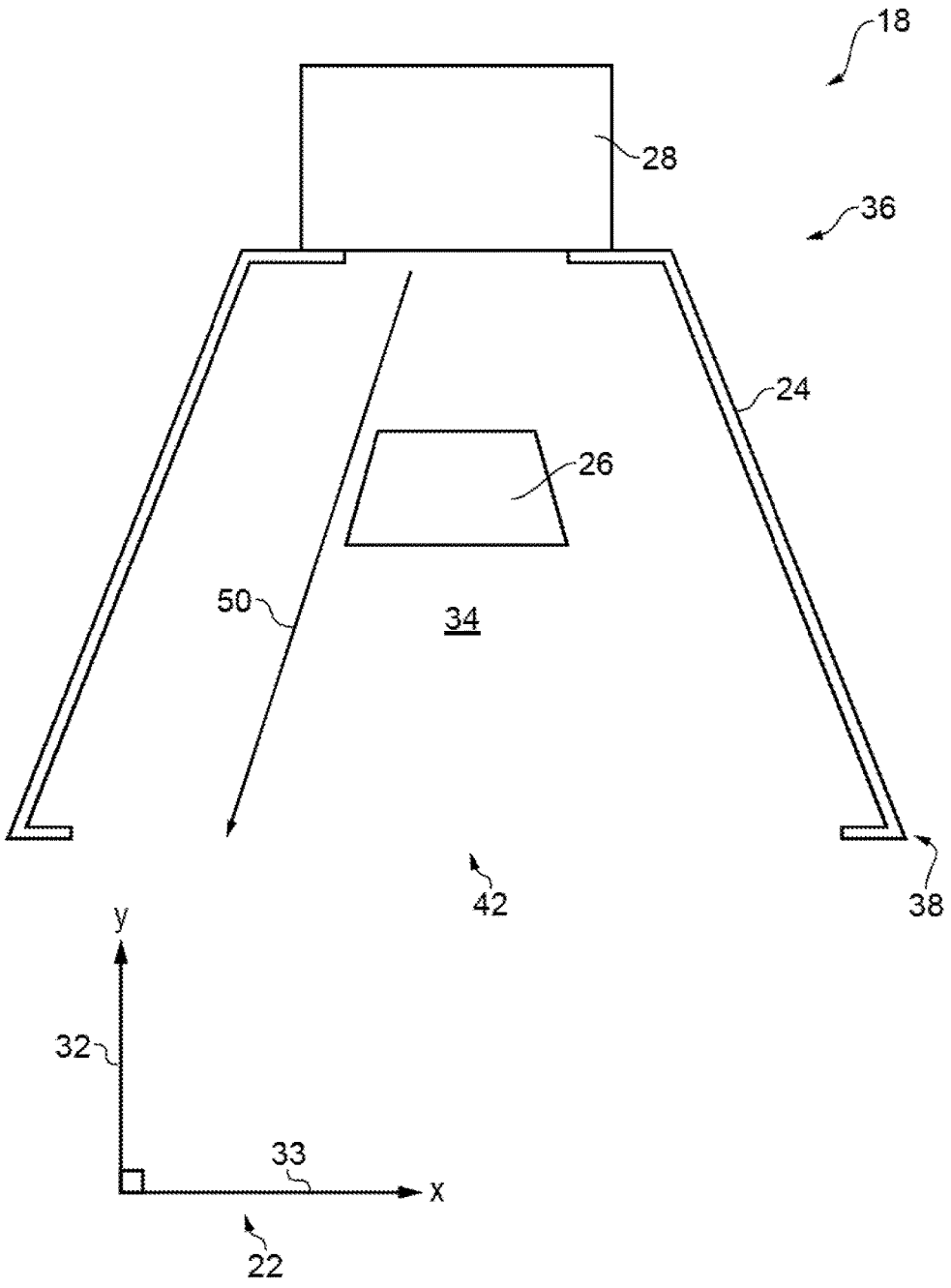
FIG. 3 illustrates a cross-sectional front view diagram of the apparatus illustrated in FIG. 2.

As illustrated in FIG. 3, the cross sectional shape of the housing 24 (when viewed from the front) has a trapezium (trapezoid) shape where the first end 36 forms the shorter base side, and the second end 38 forms the longer base side. Consequently, the dimension of the housing 24 in the X axis 30 increases from the inlet 40 to the outlet 42.

The fan 28 may be any suitable mechanism to provide a flow of gas to the cavity 34 of the housing 24. The fan 28 is positioned outside of the housing 24 and adjacent the inlet 40 to provide a flow of gas (such as air) to the cavity 34 via the inlet 40.

The heater 26 may be any suitable mechanism to heat the gas flowing through the cavity 34 from the inlet 40 to the outlet 42. For example, the heater 26 may comprise at least one resistor to convert electrical energy into thermal energy. The heater 26 is positioned within the cavity 34 of the housing 24 to heat gas from the inlet 40.

The heater 26 may be shaped to correspond to the changing cross section of the housing 24. In this example, the heater 26 has a trapezium (trapezoid) shape that corresponds to the trapezium shape of the housing 24. In more detail, the cross sectional shape of the heater 26 (when viewed from the side as illustrated in FIG. 2) has a trapezium (trapezoid) shape where the end of the heater 26 facing the inlet 40 forms the longer base side, and the end of the heater 26 facing the outlet 42 forms the shorter base side. The cross sectional shape of the heater 26 (when viewed from the front as illustrated in FIG. 3) has a trapezium (trapezoid) shape where the end facing the inlet 40 forms the shorter base side, and the end facing the outlet 42 forms the longer base side.

In some examples, the legs of the trapezium formed by the heater 26 have the same gradient as the legs of the trapezium formed by the housing 24. In other examples, the legs of the trapezium formed by the heater 26 may have different gradients to the legs of the trapezium formed by the housing 24.

In some examples, the heater 26 may be positioned at a location between the inlet 40 and outlet 42 to reduce (and to minimize in some examples) the volume of heated gas within the cavity 34 of the housing 24, but still heat the gas to a desired temperature. In more detail, the heater 26 is positioned away from the inlet 40 in the Y axis 32 and may be positioned approximately halfway between the inlet 40 and the outlet 42. This may advantageously reduce thermal energy loss from the apparatus 18 because a reduced surface area of the walls of the apparatus 18 is heated by the heated gas. Consequently, the positioning of the heater 26 may maximize the temperature of the heated gas egressing from the outlet 42.

The outlet 42 defines at least one slot shaped nozzle 44 to provide heated gas to the printed media. The at least one slot shaped nozzle 44 is advantageous in that the at least one slot nozzle 44 occupies a relatively large surface area of the outlet 42 (relative to circular apertures) and consequently minimizes the thermal energy loss from the heated gas to the outlet 42.

Figure 4:
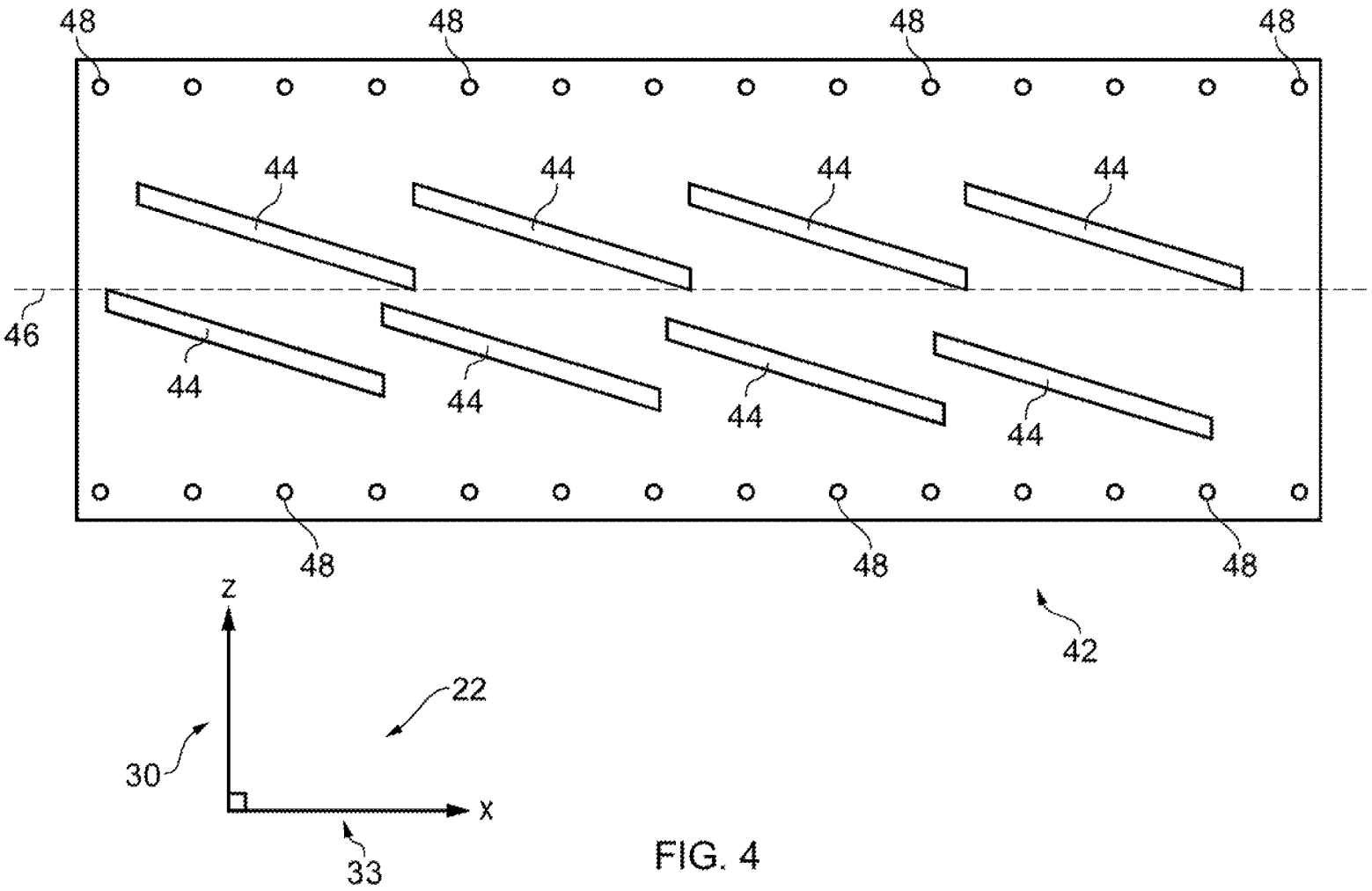
FIG. 4 illustrates a plan view of an outlet according to an example.

FIG. 4 illustrates a plan view of an outlet 42 according to an example, and the Cartesian coordinate axis 22. In this example, the outlet 42 defines a plurality of slot shaped nozzles 44. The outlet 42 has a longitudinal axis 46 that is oriented parallel to the X axis 33. The plurality of slot shaped nozzles 44 are inclined relative to the longitudinal axis 46. That is, the longitudinal axis of the slot shaped nozzles 44 form angles with the longitudinal axis 46 of the outlet 42. In operation, printed media 16 is moved perpendicularly to the longitudinal axis 46 of the outlet 42 and parallel to the Z axis 30.

The plurality of slot shaped nozzles 44 are arranged as an array having two rows and four columns. The slot shaped nozzles 44 in the first and second rows are offset relative to one another in the X axis 33 so that the plurality of slot shaped nozzles 44 at least partially overlap one another. The array of slot shaped nozzles 44 advantageously provides a uniform flow of heated gas across the outlet 42 because they provide a constant nozzle surface area along the outlet 42 in the X axis 33.

In other examples, the outlet 42 may define any number of slot shaped nozzles 44 and the slot shaped nozzles 44 may be arranged in other patterns.

For example, the slot shaped nozzles 44 may not be inclined relative to the longitudinal axis 46 of the outlet 42 and the slot shaped nozzles 44 may be arranged into any number of rows and columns.

The outlet 42 may also define a plurality of recirculation apertures 48 to enable circulation of gas from the outlet 42 to the inlet 40 via the recirculation chamber 20. In the example illustrated in FIG. 4, the outlet 42 defines a first row of circular apertures 48 that extend adjacent the first row of slot shaped nozzles 48 and parallel to the longitudinal axis 46. The outlet 42 also defines a second row of circular apertures 48 that extend adjacent the second row of slot shaped nozzles 44 and parallel to the longitudinal axis 46.

In other examples, the plurality of recirculation apertures 48 may have a different shape. For example, the plurality of recirculation apertures 48 may be slot shaped. Additionally, the plurality of recirculation apertures 48 may be arranged into other patterns. For example, the plurality of recirculation apertures 48 may be arranged into a single row adjacent either the first row of slot shaped nozzles 44 or the second row of slot shaped nozzles 44.

The housing 24 defines a direct path 50 between the inlet 40 and the outlet 42. In other words, the housing 24 is arranged so that gas entering via the inlet 40 is not redirected within cavity 42 in order to egress the housing 24 via the outlet 42. In more detail, the housing 24 may define no obstructions between the inlet 40 and the outlet 42 that redirects the flow of gas within the cavity 34. For example, the housing 24 does not define any bends or turns within the cavity 34 that causes the flow of gas to change direction.

The direct path 50 defined by the housing 24 may provide an advantage in that since the flow of gas is not redirected by the housing 24 (which reduces the velocity of the gas), the apparatus 18 may provide relatively high pressure gas from the outlet 42. Furthermore, where the shape of heater 26 corresponds to the shape of the housing 24, the heater 26 may not substantially obstruct the flow of gas within the cavity 34 and may therefore enable the apparatus 18 to provide high pressure gas from the outlet 42.

In addition to the advantages mentioned in the preceding paragraphs, the apparatus 18 may be advantageous in that the apparatus 18 may be relatively small (i.e. the apparatus 18 may be relatively compact) because the slot shaped nozzles 44 are able to provide a relatively high rate of gas flow from a reduced space (relative to an outlet having circular apertures).

Figure 5:
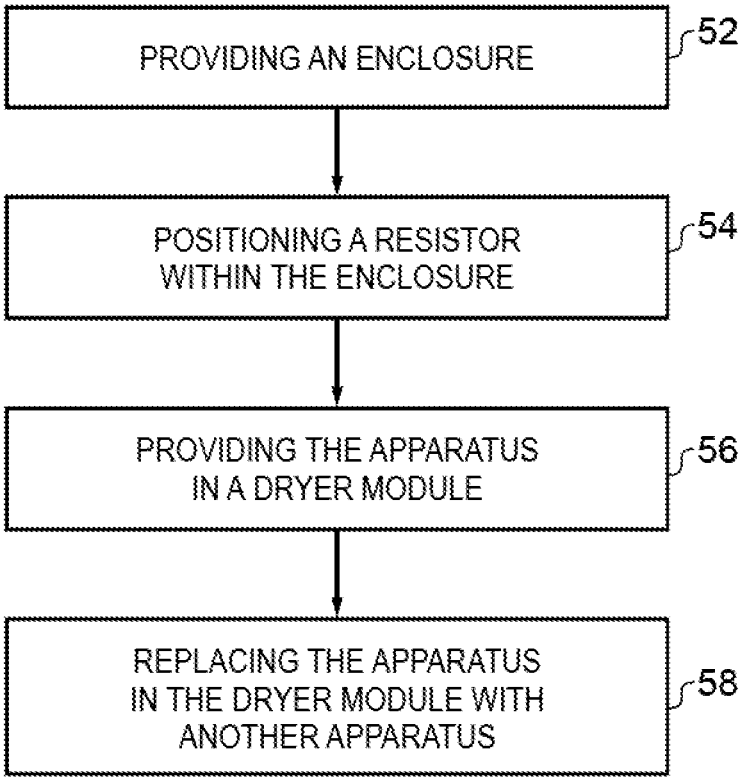
FIG. 5 illustrates a flow diagram of a method according to an example.

FIG. 5 illustrates a flow diagram of a method according to an example. At block 52, the method includes providing the housing (enclosure) 24 having the inlet 40, the outlet 42 and the cavity 34. The method may also include providing the fan 28 at block 52.

At block 54, the method includes positioning the heater (resistor) 26 within the housing 24. The heater 26 may be positioned so that the heater 26 is close to the outlet 42 to reduce the volume of heated gas within the cavity 34, but still heats the gas within the cavity 34 to a desired temperature.

At block 56, the method includes providing the apparatus 18 manufactured in blocks 52 and 54 in the dryer module 14. Block 56 may also include providing further apparatus 18 in the dryer module 14 in addition to the apparatus 18 manufactured in blocks 52 and 54.

At block 58, the method includes replacing the apparatus 18 in the dryer module 14 with another apparatus 18.

Blocks 52 and 54 may be performed by a manufacturer, whereas blocks 56 and 58 may be performed by a user of the printer apparatus 10, or by a technician of the printer apparatus 10.

The illustration of a particular order to the blocks in FIG. 5 does not necessarily imply that there is a required or preferred order for the blocks and the order and arrangement of the block may be varied in some examples. Furthermore, it may be possible for some blocks to be omitted in some examples.

Although examples have been described in the preceding paragraphs, it should be appreciated that modifications to the examples given can be made without departing from the scope as claimed.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features believed to be of particular importance it should be understood that the Applicant claims protection in respect of any patentable feature or combination of features hereinbefore referred to and/or shown in the drawings whether or not particular emphasis has been placed thereon.

What is claimed is:

1. An apparatus to provide heated gas to printed media, the apparatus comprising:

a housing including:

an inlet to receive gas from a fan; and an outlet defining at least one slot shaped nozzle to provide heated gas to the printed media, the housing defining a direct path between the inlet and the outlet, wherein a width of the housing increases from the inlet to the outlet such that a first end of the housing is smaller than a second end of the housing, the first end of the housing comprising the inlet, and the second end of the housing comprising the outlet; and a heater positioned within the housing to heat the gas from the inlet, wherein a width of the heater follows the increasing width of the housing from the inlet to the outlet such that a first end of the heater closest to the first end of the housing is smaller than a second end of the heater closest to the second end of the housing.

2. The apparatus of claim 1, wherein the heater is positioned between the inlet and outlet to reduce a volume of heated gas within the housing.

3. The apparatus of claim 1, wherein the outlet defines a plurality of slot shaped nozzles.

4. The apparatus of claim 3, wherein the plurality of slot shaped nozzles at least partially overlap one another to provide a uniform flow of heated gas across the outlet.

5. The apparatus of claim 4, wherein the plurality of slot shaped nozzles comprise a first row of slot shaped nozzles and a second row of slot shaped nozzles, the slot shaped nozzles in the first row spaced apart from the slot shaped nozzles in the second row.

6. The apparatus of claim 5, wherein the slot shaped nozzles in the first row are inclined along a first direction, and the slot shaped nozzles in the second row are inclined along the first direction.

7. The apparatus of claim 3, wherein the outlet has a longitudinal axis, and the plurality of slot shaped nozzles are inclined relative to the longitudinal axis.

8. The apparatus of claim 1, wherein the heater comprises a resistor.

9. The apparatus of claim 1, wherein the housing has a trapezoid shape, and the heater has a trapezoid shape that follows the trapezoid shape of the housing.

10. The apparatus of claim 1, wherein the width of the housing that increases from the inlet to the outlet is a first width of the housing, wherein a second width of the housing decreases from the inlet to the outlet, wherein the width of the heater that follows the increasing first width of the housing from the inlet to the outlet is a first width of the heater, and wherein a second width of the heater follows the decreasing second width of the housing.

11. An apparatus to provide heated gas to printed media, the apparatus comprising:

a housing including:

an inlet to receive gas from a fan; and an outlet defining at least one slot shaped nozzle to provide heated gas to the printed media, the housing defining a direct path between the inlet and the outlet, wherein a shape of a cross section of the housing changes between the inlet and the outlet, and wherein a first width of the housing increases from the inlet to the outlet, and a second width of the housing decreases from the inlet to the outlet; and a heater positioned within the housing to heat the gas from the inlet, wherein a width of the heater follows the increasing first width of the housing from the inlet to the outlet such that a first end of the heater closest to a first end of the housing is smaller than a second end of the heater closest to a second end of the housing, the first end of the housing comprising the inlet, and the second end of the housing comprising the outlet.

12. The apparatus of claim 11, wherein the heater is shaped to correspond to the changing shape of the cross section of the housing.

13. The apparatus of claim 11, wherein the heater is positioned between the inlet and outlet to reduce a volume of heated gas within the housing.

14. The apparatus of claim 11, wherein the outlet defines a plurality of slot shaped nozzles comprising a first row of slot shaped nozzles and a second row of slot shaped nozzles, and wherein the slot shaped nozzles in the first row are inclined along a first direction, and the slot shaped nozzles in the second row are inclined along the first direction.

15. The apparatus of claim 11, wherein another width of the heater follows the decreasing second width of the housing from the inlet to the outlet such that a first end along the another width of the heater closest to the first end of the housing is larger than a second end along the another width of the heater closest to the second end of the housing.

16. The apparatus of claim 11, wherein the first width of the housing is along a first axis, and the second width of the housing is along a second axis perpendicular to the first axis.

17. A printer apparatus comprising:

a dryer module comprising:

a housing including:

an inlet to receive gas from a fan; and an outlet defining at least one slot shaped nozzle to provide heated gas to printed media, the housing defining a direct path between the inlet and the outlet, wherein a width of the housing increases from the inlet to the outlet such that a first end of the housing is smaller than a second end of the housing, the first end of the housing comprising the inlet, and the second end of the housing comprising the outlet; and a heater positioned within the housing to heat the gas from the inlet, wherein a width of the heater follows the increasing width of the housing from the inlet to the outlet such that a first end of the heater closest to the first end of the housing is smaller than a second end of the heater closest to the second end of the housing.

18. The printer apparatus of claim 17, wherein the dryer module further comprises a recirculation chamber, and wherein the outlet defines a plurality of recirculation apertures to enable circulation of gas from the outlet to the inlet via the recirculation chamber.

* * * * *

UNITED STATES PATENT AND TRADEMARK OFFICE

CERTIFICATE OF CORRECTION

PATENT NO. : 10,245,850 B2
APPLICATION NO. : 15/314992
DATED : April 2, 2019
INVENTOR(S) : Nuria Espinar Lacueva et al.

It is certified that error appears in the above-identified patent and that said Letters Patent is hereby corrected as shown below:

On the Title Page

Item (57), Abstract, Line 1, delete “punted” and insert -- printed --, therefor.

Signed and Sealed this
Sixth Day of August, 2019

Andrei Iancu
*Director of the United States Patent and Trademark Office*